United States Patent [19]

Ashford

[11] 4,107,513

[45] Aug. 15, 1978

[54] SHAMPOO AND CONDITIONER WARMER

[76] Inventor: Bryan Ashford, 409 Ker Ave., Victoria, British Columbia, Canada, V9A 2B8

[21] Appl. No.: 812,798

[22] Filed: Jul. 5, 1977

[51] Int. Cl.[2] ..... H05B 3/06

[52] U.S. Cl. ..... 219/521; 165/76; 165/107 R; 219/281; 219/386; 219/430; 219/433; 219/530

[58] Field of Search ..... 219/200, 281, 214, 385, 219/386, 415, 430, 432, 433, 434, 435, 436, 437, 439, 518, 521, 524, 525, 530, 540; 62/298, 299; 165/76, 80, 107; 126/215

[56] References Cited

U.S. PATENT DOCUMENTS

| | | | |
|---|---|---|---|
| 2,269,874 | 1/1942 | Henschel | 219/521 X |
| 2,424,161 | 7/1947 | Gunther | 219/433 |
| 2,711,882 | 6/1955 | Narbutowskih | 165/107 X |
| 2,753,435 | 7/1956 | Jepson | 165/46 X |
| 2,836,700 | 5/1958 | Chapman | 219/281 |
| 2,932,718 | 4/1960 | Marsters | 219/521 |
| 2,978,225 | 4/1961 | Dallas, Jr. | 165/46 |
| 3,098,925 | 7/1963 | Fouts et al. | 219/214 |

*Primary Examiner*—Volodymyr Y. Mayewsky

[57] ABSTRACT

A plurality of receptacles are provided each having pockets for receiving a bottle containing a shampoo or hair conditioner to be warmed. Each receptacle includes a U-shaped water conduit having a pair of legs extending beyond one side wall thereof. The bight portion of each conduit is closed by a spring loaded flap valve extending parallel to the bight. An opening is provided behind each flap valve which is in line with the legs of the U-shaped conduit. A first receptacle is connected to a pair of openings in a master heating unit containing a thermostat, a heating coil, and a pump for pumping water from a source past the heating coil through one of the openings in the U-shaped conduit of the first receptacle and back to the other side of the pump through the other leg of the U-shaped conduit in the first receptacle, warming the contents of the bottles supported within the first receptacle. A second receptacle of identical construction can be connected to the first receptacle by having the ends of the legs of its U-shaped conduit inserted in the openings behind the flap valves closing the conduit in the first receptacle to push flap valves to a position closing the bight portion and establishing communication between the legs of the conduits in the first and second receptacles so that bottles supported within the second receptacle may be heated by water received from the first receptacle through one leg and returned to the first receptacle through the other leg.

4 Claims, 3 Drawing Figures

SHAMPOO AND CONDITIONER WARMER

PRIOR ART

The following patents are considered pertinent: U.S. Pat. Nos. 1,404,317; 2,016,358; 2,278,994; 2,370,238; 2,424,161; 2,836,700; 2,932,718; 3,098,925.

BACKGROUND OF THE INVENTION

This invention relates to a bottle warmer, and more particularly, a bottle warmer for heating shampoo and hair conditioners contained in bottles.

The complaint often heard in barber shops, beauty salons and the like is that when shampoo and hair conditioners are applied to the scalp of a person they are cold, causing the patron to become tense and not relax for treatment. This invention relates to a heating apparatus in which such shampoos and hair conditioners can be readily heated prior to application.

While bottle warmers generally are known in the prior art, such devices are used to heat the contents of a single bottle, such as a bottle containing milk or the like for feeding to babies. The present invention, on the other hand, relates to heating of a plurality of bottles at the same time containing different shampoos and hair conditioners all used within a beauty salon or barber shop. Further, a plurality of such bottles can be heated in an individual warmer or heating unit which can be added to the apparatus as required.

SUMMARY OF THE INVENTION

In accordance with the invention, a plurality of individual hot water bottle warming units are provided for supporting and heating a plurality of bottles containing hair conditioner and/or shampoo. Each unit may be connected in tandem to a main heating unit containing a thermostat and pump connected to a source of hot water wherein the water is flowed past a heating coil and circulated through an adjacent hot water warming unit or units containing a plurality of bottles. Each unit contains a pipe which can be connected in series to an adjacent unit for receiving the circulated water, as required. The pipe is received within an opening in the adjacent unit and is adapted to open a spring loaded valve connecting it in series with a pipe within the interior of the adjacent unit receiving circulated water. Upon removal or disassembly of the adjacent units, the valve returns to its normal position closing the end of the pipe and diverting the circulating water back to its source rather than to an adjacent unit.

BRIEF DESCRIPTION OF THE DRAWING

Further objects and advantages of the invention will become apparent from the following description and claims, and from the accompanying drawings, wherein:

DETAILED DESCRIPTION OF THE PREFERRED EMBODIMENT

Figure 1:
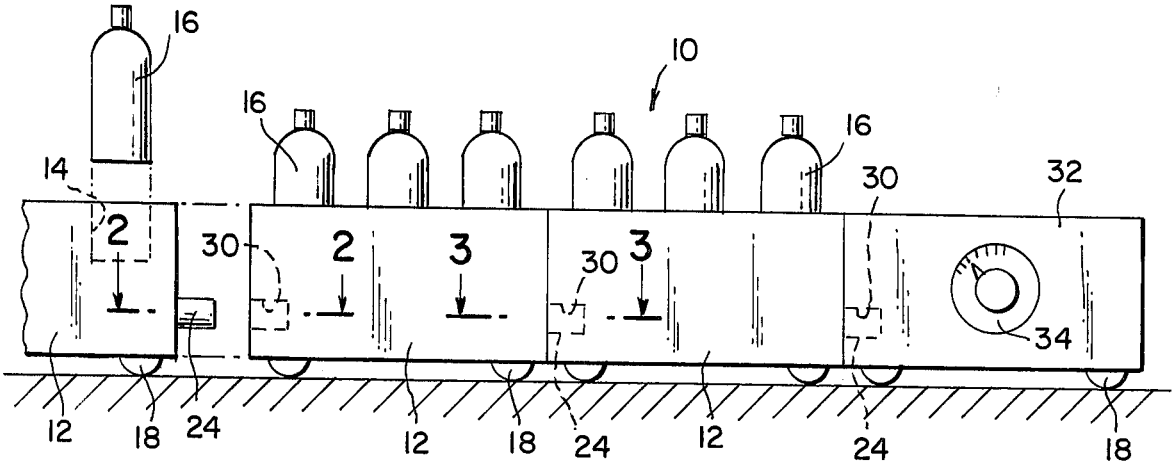
FIG. 1 is a side view in elevation of the shampoo and conditioner warming apparatus of the present invention.

Referring now to the drawing in detail, wherein like numerals indicate like elements throughout the several views, the warming apparatus 10 of the present invention includes a plurality of receptacles 12, each of which has a plurality of cylindrical pockets 14 for receiving a hair conditioner or shampoo applicator bottle 16.

Each receptacle can be mounted on wheels 18 and includes a substantially U-shaped conduit 20 formed by pipes 22 for circulating hot water through the base of each receptacle 12. The legs of the U-shaped conduit 20 include a portion 24 extending outwardly beyond one side of receptacle 12. The opposite ends of each of the pipes 22 is closed by a spring loaded flap valve 26 having a normal position extending perpendicular across the bottom of each leg of pipe 22 or parallel to the bight portion 28 of each conduit 20. A pair of openings 30 are formed adjacent the opposite side of receptacle 12 behind each of the flap valves 26 in the pipes 22.

As shown in FIG. 1, apparatus 10 includes a main heater housing 32 containing a thermostat 34 mounted on the front wall thereof electrically connected to a heating coil and pump (not shown) in receptacle 32. The pump may be connected to a suitable source of water such as tap water, while the heating coil is connected in a conventional manner by a plug to a wall outlet providing a source of electrical energy.

Receptacle 32 also contains a pair of openings 30 in communication with the pump in receptacle 32. The pipe extensions 24 and one of the receptacles 12 may be inserted within openings 30 in receptacle 32. Similarly, the pipe extensions 24 on subsequent receptacles, as needed, may be inserted within the openings 30 in an adjacent receptacle 12 as shown in FIG. 1.

Figure 2:
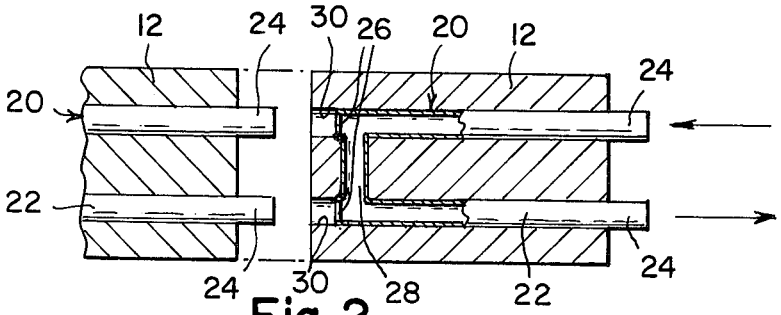
FIG. 2 is a cross-sectional view taken substantially along the plane indicated by line 2—2 of FIG. 1.
Figure 3:
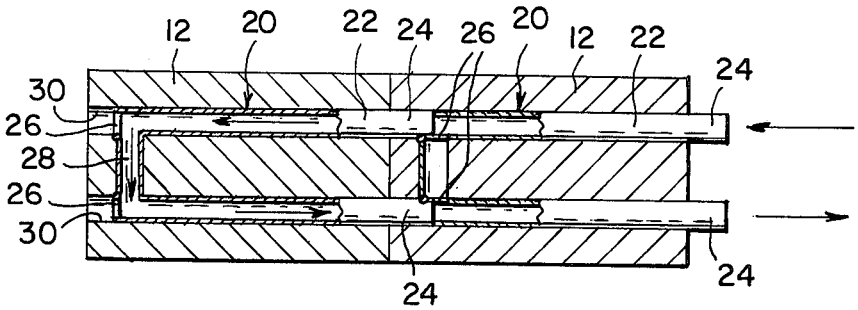
FIG. 3 is a cross-sectional view taken substantially along the plane indicated by line 3—3 of FIG. 1.

Normally, water will be circulated by the pump in receptacle 32 at a preset temperature determined by thermostat 34 through the U-shaped conduit 20, that is through the legs of pipe 22 and bight portion 28 of each conduit 20 to warm any bottles 16 received within pockets 14 within receptacle 12. However, should a subsequent receptacle 12 be connected in tandem by insertion of pipe ends 24 in openings 30, the pipe ends will contact flap valves 26 as shown in FIGS. 2 and 3 and pivot the flap valves to a position closing the bight portion 28 of the first receptacle 12 to cause water to circulate as indicated by the arrows in FIG. 3, through one of the legs of the first receptacle 12, a leg of the second receptacle 12, the bight portion 28 of pipe 22, the second receptacle 12, a second leg of the second receptacle 12 and a second leg 22 of the first receptacle 12 back to the pump. In this manner, receptacles 12 connected in tandem can be used to heat additional applicator bottles 16.

Upon removal of the second receptacle 12, the flap valves 26 revert to their normal position precluding communication between openings 30 and the legs of each pipe 22 causing water to circulate through the bight portion 28 of the first receptacle so this unit alone is capable of heating a plurality of applicator bottles 16.

While a specific embodiment of a shampoo and conditioner warmer has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A bottle warming apparatus comprising:

a housing containing a pump adapted to be connected to a source of water and heating coil means for heating said water, said housing having a fluid inlet and a fluid outlet, a receptacle for receiving a plurality of bottles containing liquid to be warmed, said receptacle including a fluid conduit formed by a substantially U-shaped pipe having a fluid inlet end and a fluid outlet end extending beyond a side wall of said receptacle for receipt in the fluid outlet and fluid inlet in said housing, respectively, so as to be placed in communication with said pump.

2. The apparatus of claim 1 wherein the bight portion of said U-shaped pipe in said receptacle includes a pair of spring-loaded valves normally extending parallel to said bight, and an opening forming a continuation of each of the legs of said U-shaped conduit behind each of said valves, and a second receptacle having substantially U-shaped conduit including a pair of legs having an extension extending exteriorly of a side wall thereof adapted to be received in said openings behind said valves and to move said valves to a position across the interior of the bight portion of said U-shaped conduit of said first receptacle to establish communication between the legs of the U-shaped conduit of said first receptacle and the legs of the U-shaped conduit and bight portion of said second receptacle.

3. The apparatus of claim 2 wherein said valve is a flap valve.

4. The apparatus of claim 3 wherein said second receptacle includes a spring-loaded pivotable flap valve normally closing the end of each of said legs of the U-shaped conduit of said second receptacle, and an opening behind each of said flap valves adapted to receive a pipe extension on another receptacle.

* * * * *